US007420110B2

(12) United States Patent
May

(10) Patent No.: US 7,420,110 B2
(45) Date of Patent: Sep. 2, 2008

(54) CARRIER ASSEMBLY FOR PERCUSSION INSTRUMENTS

(76) Inventor: Randall L May, 2 Trafalgar, Newport Beach, CA (US) 92660

( * ) Notice: Subject to any disclaimer, the term of this patent is extended or adjusted under 35 U.S.C. 154(b) by 442 days.

(21) Appl. No.: 11/020,923

(22) Filed: Dec. 23, 2004

(65) Prior Publication Data

US 2005/0103183 A1 May 19, 2005

Related U.S. Application Data

(60) Continuation-in-part of application No. 10/950,130, filed on Sep. 27, 2004, which is a continuation-in-part of application No. 10/831,638, filed on Apr. 23, 2004, now Pat. No. 6,881,886, which is a continuation-in-part of application No. 10/374,676, filed on Feb. 26, 2003, now Pat. No. 7,071,401, which is a continuation-in-part of application No. 10/170,005, filed on Jun. 10, 2002, now Pat. No. 6,770,805, which is a continuation-in-part of application No. 09/756,479, filed on Jan. 8, 2001, now Pat. No. 6,403,869, which is a continuation-in-part of application No. 09/497,266, filed on Feb. 3, 2000, now Pat. No. 6,329,583, which is a division of application No. 08/976,999, filed on Nov. 24, 1997, now Pat. No. 6,028,257, which is a continuation-in-part of application No. 08/588,244, filed on Jan. 18, 1996, now Pat. No. 5,691,492.

(51) Int. Cl.
*G10D 13/02* (2006.01)

(52) U.S. Cl. ..... 84/421; 84/411 R

(58) Field of Classification Search ..... None
See application file for complete search history.

(56) References Cited

U.S. PATENT DOCUMENTS

| | | | | |
|---|---|---|---|---|
| 4,102,237 | A * | 7/1978 | Suess et al. | 84/421 |
| 4,256,007 | A | 3/1981 | Streit | |
| 4,387,839 | A | 6/1983 | Dranchak | |
| 4,402,441 | A | 9/1983 | Jones et al. | |
| 4,453,442 | A | 6/1984 | LaFlame | |
| 4,453,446 | A | 6/1984 | Hoshino | |
| 4,605,144 | A | 8/1986 | LaFlame | |
| 4,634,032 | A | 1/1987 | LaFlame | |
| 4,796,508 | A | 1/1989 | Hoshino | |

(Continued)

OTHER PUBLICATIONS

U.S. Appl. No. 10/374,676, filed Nov. 2003, May.

(Continued)

*Primary Examiner*—Marlon T Fletcher
(74) *Attorney, Agent, or Firm*—Buhler & Associates; Kirk A. Buhler

(57) ABSTRACT

A percussion instrument holder that allows attachment to a user mounted carrier. The holder allows adjustment for positioning about the user, and pivoting of the holder to allow the holder to pivot or rotate up to allow the holder with instruments to fit a narrower space. The holder further allows for pivotal attachment of individual drums to link or pivot allowing the linked drums to articulate. The holder can also consist of members that allow a connected drum to move in horizontal position, angle, or height of the drum.

22 Claims, 9 Drawing Sheets

U.S. PATENT DOCUMENTS

| | | | | | |
|---|---|---|---|---|---|
| 4,799,610 | A | | 1/1989 | Hesieh | |
| 5,309,811 | A | * | 5/1994 | Hoshino | 84/421 |
| 5,400,683 | A | | 3/1995 | LaFlame | |
| 5,520,292 | A | | 5/1996 | Lombardi | |
| 5,573,158 | A | * | 11/1996 | Penn | 224/265 |
| 5,973,247 | A | * | 10/1999 | Matthews | 84/402 |
| 5,973,248 | A | * | 10/1999 | Chen | 84/421 |
| 6,028,257 | A | * | 2/2000 | May | 84/421 |
| 6,075,190 | A | * | 6/2000 | Mosser et al. | 84/421 |
| 6,172,290 | B1 | | 1/2001 | May | |
| 6,323,407 | B1 | | 11/2001 | May | |
| 6,329,583 | B1 | | 12/2001 | May | |
| 6,346,665 | B1 | * | 2/2002 | Liao | 84/421 |
| 2005/0284284 | A1 | * | 12/2005 | Izen et al. | 84/411 R |
| 2006/0021493 | A1 | * | 2/2006 | Lewis | 84/411 R |
| 2006/0081114 | A1 | * | 4/2006 | Shimada | 84/421 |

OTHER PUBLICATIONS

U.S. Appl. No. 10/170,005, filed Jan. 2003, May.
U.S. Appl. No. 09/756,479, filed Dec. 2001, May.

* cited by examiner

CARRIER ASSEMBLY FOR PERCUSSION INSTRUMENTS

CROSS REFERENCE TO RELATED APPLICATION

This application is a continuation-in-part of applicant's applications U.S. application Ser. No. 10/950,130, filed Sep. 27, 2004 which is a continuation-in-part of 10/831,638 filed Apr. 23, 2004 now U.S. Pat. No. 6,881,886 issued Apr. 19, 2005 which is a continuation-in-part of 10/374,676 filed Feb. 26, 2003 now U.S. Pat. No. 7,071,401 issued Jul. 4, 2006 which is a continuation-in-part of 10/170,005 filed Jun. 10, 2002 now U.S. Pat. No. 6,770,805 issued on Aug. 3, 2004 which is a continuation-in-part of 09/756,479 filed Jan. 8, 2001 now U.S. Pat. No. 6,403,869 issued Jun. 11, 2002 which is a continuation-in-part of 09/497,266 filed Feb. 3, 2000 now U.S. Pat. No. 6,329,583 issued Dec. 11, 2001 which is a divisional application of 08/976,999 filed Nov. 24, 1997 now U.S. Pat. No. 6,028,257 issued Feb. 22, 2000 which is a continuation-in-part of 08/588,244 filed Jan. 18, 1996 now U.S. Pat. No. 5,691,492 and claims incorporation by reference herein.

FIELD OF THE INVENTION

This invention relates to new and useful improvements in apparatus for supporting or carrying percussion instruments, particularly drums of various kinds.

BACKGROUND OF THE INVENTION

The prior art discloses many examples of apparatus for supporting percussion instruments but none providing the combination of features disclosed and claimed herein.

May U.S. Pat. No. 5,691,492 discloses hardware for supporting drums that is of a hinged construction and has one part of the hinge connectable to an external support, e.g., J-rods on a fixed support or a marching drum carrier, and another part of the hinge connectable to the shell of a drum or to the tension rods on a drum or to other hardware on the drum.

May U.S. Pat. No. 6,028,257 shows drum hardware and drums secured thereon preferably supported on a vest type carrier or a T-bar carrier or a fixed post or pedestal.

May U.S. Pat. No. 6,172,290 shows a hinged support for an array of drums.

May U.S. patent application Ser. No. 09/756,479, filed Jan. 8, 2001, allowed Jan. 28, 2002, shows a hinged support for one or more drums having means for adjusting the position of a drum to a fixed support or drum carrier. The hinged support may be for an array of drums having means for adjusting the position of the drum array pivotally and inwardly and outwardly relative to fixed drums.

Other possibly relevant prior art is Pyle U.S. Pat. No. 5,054,357; May U.S. Pat. No. 5,072,910 and May U.S. Pat. No. 5,300,810.

Various prior inventions have been disclosed that attempt to provide percussion positioning and locating apparatus, but none of the listed inventions provide the combination of features and functions proposed by the disclosed carrier.

BRIEF SUMMARY OF THE INVENTION

A percussion instrument holder that allows attachment to a user mounted carrier. The holder allows adjustment for positioning about the user, and pivoting of the holder that allows the holder to slide, pivot or rotate to allow the holder with instruments to fit a narrower space. The holder further allows for pivotal attachment of individual drums to link and pivot to allow the linked drums to articulate. The drums can be fully adjusted in relation to one another, similar to moving links in a chain. The holder can also consist of members that allow a connected drum to move in horizontal position, angle, or height of the drum.

One of the objects of this invention is to provide a new and improved hinged support for an array of drums for support on a pedestal or marching type carrier. The hinge allows all the instruments connected to the rail to hinge as a group.

Another object of the invention is to provide a new and improved hinged support for an array of drums for support on a pedestal or marching type carrier having means for adjusting the position of a drum array relative to fixed drums thereon.

Another object of the invention is to provide a new and improved hinged support for an array of drums for support on a pedestal or marching type carrier having means for adjusting the position of a drum array pivotally and inwardly and outwardly relative to fixed drums thereon. Another object of the invention is to provide a new and improved hinged support for an array of drums for support on a pedestal or marching type carrier having means for adjusting the position of the drums in a drum array relative to each other. The adjustment on the tenor rail or back bar can be narrowed or widened, offset left or right to balance weight. The adjustments can allow the drums to move or slide closer or further away from the body for playing comfort.

Another object of the invention is to provide a new and improved hinged support for an array of drums for support on a pedestal or marching type carrier having novel means for supporting the drums thereon.

Another object of the invention is to provide a new and improved hinged support for drums for support on a pedestal or marching type carrier by J-rod supports.

Another object of the invention is to provide a new and improved means for connecting a hinged support for an array of drums for support on individual drums. Another object of the invention is to provide a new and improved means for connecting a hinged support for an array of drums for support on individual drums, and having hinged sliders for the supporting J-rods of the hardware.

Another object of the invention is to provide new and improved supporting hardware supporting an array of drums, as in a marching drum assembly, having a tubular structure supporting a plurality of drums for pivotal and inward and outward adjustment of the drums.

Another object of the invention is to provide a new and improved hinged support having a back bar or tenor rail for supporting an array of drums for support on a pedestal or marching type carrier in which drums are adjustably supported on rails of a back bar assembly and having J-rod supports adjustable supported thereon.

Another object of the invention is to provide a new and improved hinged support having a back bar assembly for supporting an array of drums for support on a pedestal or marching type carrier in which the back bar assembly is adjustable in length for adjusting the location of drums thereon.

Another object of the invention is to provide a new and improved hinged support for an array of drums for support on a pedestal or marching type carrier having means for pivotally adjusting the position of one drum in the array relative to another.

Another object of the invention is to provide new and improved supporting hardware supporting an array of drums, and having a tubular swivel support for the drums fitting existing lugholes in the drums.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION SUPPORTING HARDWARE OF THIS INVENTION

Figure 1:
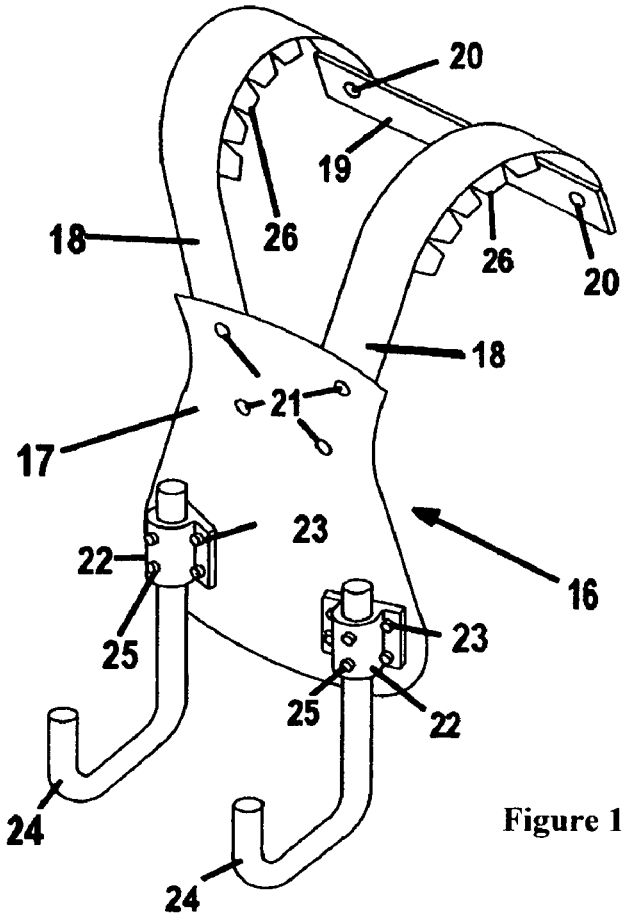
FIG. 1 is an isometric view of a supporting vest and J-bars for supporting marching drum assemblies as described below.
Figure 2:
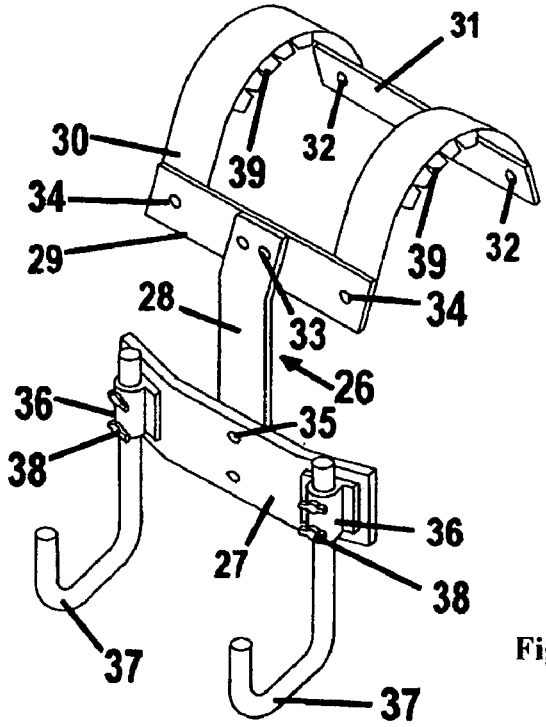
FIG. 2 is an isometric view of a novel T-bar assembly and J-rods for supporting drums containing features of the supporting vest of FIG. 1 for marching drums as described below.

FIGS. 1 and 2 illustrate prior art devices for supporting the drum hardware shown in FIGS. 3-22. FIGS. 1 and 2 show vest and T-bar constructed instrument carrier, but tubular and other forms of vest construction can be used to support the drum hardware used for carrying drums in marching bands.

Referring to FIG. 1, there is shown a vest- or harness-type 16 carriers for percussion instruments that comprises a vest portion 17, shoulder straps 18 and back bar 19. Back bar 19 is removably secured to shoulder straps 18 by screws or bolts 20. Where desired, back bar 19 may be fixed as by welding or the like. Vest portion 17 is removably secured to shoulder straps 18 by screws or bolts 21 and has a pair of J-bar receptacles 22 secured by screws or bolts 23. J-bars 24 are supported in receptacles 22 and secured in position by T-bolts or set screws 25. J-bar receptacles may also be used of the type shown in FIGS. 38-41 and 51-55 of May U.S. Pat. No. 6,028,257. The J-bar receptacles are show because they are the current method used to connect the drum hardware to the carrier. Other methods of attachment are contemplated that perform similar function, such as mounting the drum hardware directly to sliders on the carrier, or "U" or "O" shaped receptacles. In the preferred embodiment, the receiver(s) are made from hollow J-rod clamping receptacles. Shoulder straps 18 have pads 26 to cushion the load of the instruments carried by carrier 16. This carrier 16 is constructed and used as in May U.S. Pat. No. 5,691,492.

Referring to FIG. 2, there is shown a T-bar-type carrier 26 for percussion instruments, which comprises a belly plate 27, vertical bar 28, upper horizontal bar 29, shoulder straps 30 and back bar 31. Back bar 31 is removably secured to shoulder straps 30 by screws or bolts 32. Where desired, back bar 31 may be fixed as by welding or the like. Upper horizontal bar 29 is removably secured to shoulder straps 30 by screws or bolts 34. Upper horizontal bar 29 is removably secured to the upper end of vertical bar 28 by screws or bolts 33.

Belly plate 27 is removably secured to the lower end of vertical bar 28 by screws or bolts 35. A pair of J-bar receptacles 36 is secured on belly plate 27 by screws or bolts or the like. J-bar receptacles may also be used of the type shown in FIGS. 38-41 and 51-55 of May U.S. Pat. No. 6,028,257. J-bars 37 are supported in receptacles 36 and secured in position by T-bolts 38. Shoulder straps 30 have pads 39 to cushion the load of the instruments carried by T-bar carrier 26. This carrier 26 is constructed and used as in May U.S. Pat. No. 5,691,492.

An Embodiment for Supporting Drum Arrays

FIGS. 3-6 show a back bar or hinge assembly 41 to provide support for a multiple drum assembly or array 40 (FIGS. 3 and 4) as used in marching bands. The back member or hinge assembly is also called a tenor rail or tenor back member because one or more tenor drums can be attached to the rail. Hinge assembly 39 is similar in function to that shown in FIGS. 13-17 of May U.S. Pat. No. 6,028,257 with additional features permitting adjustability that is not possible in the embodiment of the patent.

Multiple drum assembly or array 40 (FIG. 3) comprises typically 2-6 drums secured together for support and carrying by a drummer as in a marching band. Drum array 40 includes one or more snare drums 53 supported on the fixed part of a hinge assembly and a plurality of large drums 54 supported on the hinge parts of a hinge assembly. The individual drums 54 of drum array 40 are preferably larger drums ranging about 8"-14" in diameter. Drum 53 on back bar assembly 41 is preferably a smaller drum about 6" in diameter. The array of drums can be all the same size and tone of drums, all different size and tone, or a combination thereof.

In this embodiment, hinge assembly 39 provides a hinged support between the drum array 40 and a suitable marching carrier 16 or 26 as shown in FIGS. 1 and 2. Hinge assembly 39 (FIGS. 5 and 6) comprises a back bar or bars 41 that is/are fixed member of the hinge. Back bar(s) 41 have/has two end pieces 42 each of which comprises a one-piece casting having a flat portion 43 with a bent portion at a right angle thereto.

Figure 5:
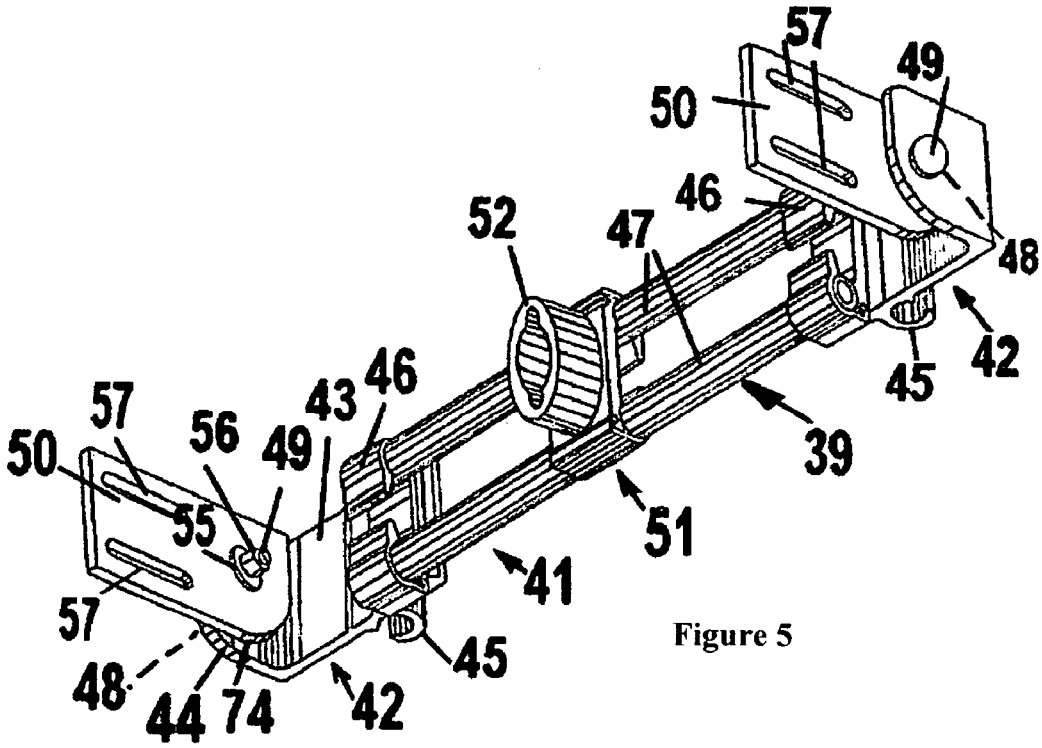
FIG. 5 is an isometric view of the hinge assembly shown in FIG. 3 and FIG. 4 with a single mounting support for snare drums.

Flat portion 43 has a J-rod receptacles or receivers 45 formed integral therewith on the underside as viewed in FIG. 5. J-rods 24 in FIG. 1 or 37 in FIG. 2 are supported in receptacles 45 and secured in position by compression fit. Two receptacles 46 are formed integral with the upper surface of flat portion 43. Back bar assembly have two cylindrical rods 47, which fit, into receptacles 45 to secure the assembly together. In this embodiment, the two cylindrical rods support the structure for the J-rod receptacles, but numerous other back bar members are contemplated that perform equivalent function. Other types of back members may include but are not limited to one or more tubes or rods of various shapes including round, square, rectangular, elliptical, octagonal and others. The back member may be a single plate or extrusion that performs the function of connecting the carrier to a drum or a drum array. The adjustment to the back member may include width adjustment that allows the back member to widen, or narrow to accommodate instruments or users. The receiver(s) on the back member allow lateral adjustment of the receptacles or receivers. The lateral adjustment allows the receivers to slide on the back member. The receiver(s) can be positioned in finite or infinite locations. The receiver locations can be located symmetrically, non-symmetrically, offset right, left, widened or narrowed on the back member. As the receiver(s) are moved on the back member the array of drums may move closer or farther away from the carrier.

Re-bent end portions have holes 48 (FIGS. 5 and 6) providing a tilt or pivot for the hinge. Holes 48 in each bent end portion of back bar flat portion 43 have bolts 49 inserted there through to secure hinge plates 50 which support the drum array 40 for pivotal movement. The pivotal or tilt allows the drums attached to the back bar to be rotated about the axis of the hinge or the carrier. This allows the array to occupy a smaller space and allows the user and the array to fit through a doorway or between objects that may not be able to pass through if the drums would not pivot or tilt. The array of drums may also tilt to a fixed angle to allow easier playing of the drums. The angle may be finite or infinite increments. The pivoting may be locked in orientation or free to move without loosening a clamp or locking mechanism. A supporting member 51 is slidably supported on rods 47 to support the snare drums 53 (FIG. 3).

Figure 3:
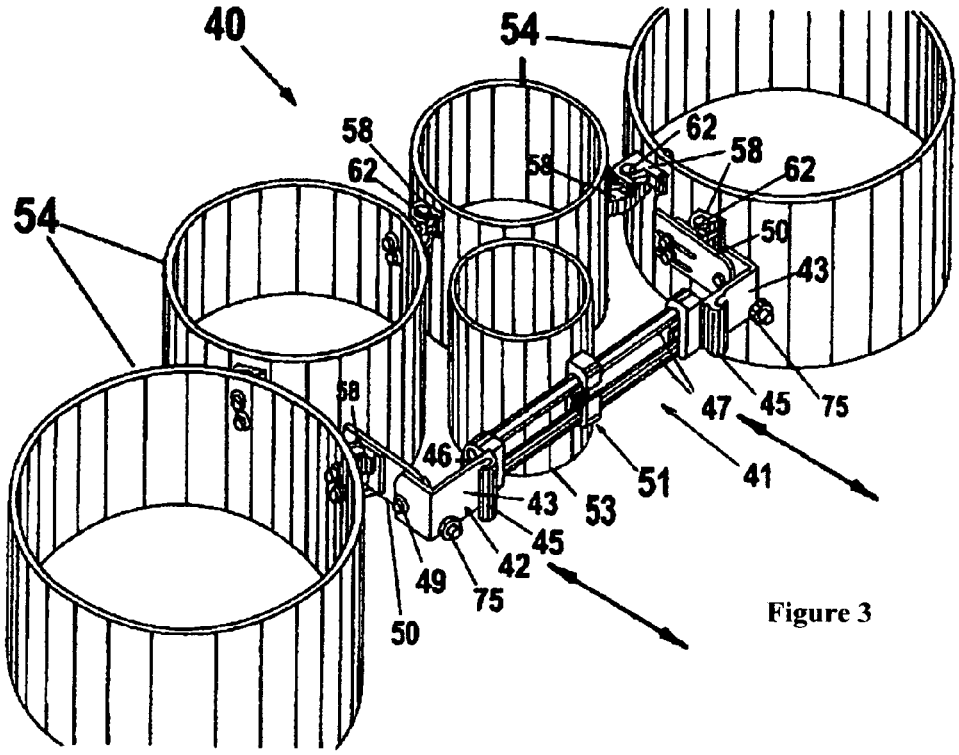
FIG. 3 is an isometric view of the embodiment of supporting hardware illustrating inward and outward adjustment of the drums.

FIG. 3 shows details of the connection of a single snare drum 53 (FIG. 3) or two snare drums 53 (FIG. 7) to back bar assembly 41. In this embodiment, a hollow standoff or spacer boss spaces 52, shown in FIG. 5, and supports drum 53 from sliding member 51 on back bar assembly 41. The hardware that attaches to the drum uses existing holes in the drum that secures the drum casing on the drum. Bolts extend through washers, holes in the drum wall, spacer boss, holes in hinge back bar assembly 41, washers, and are secured by nuts.

Figure 6:
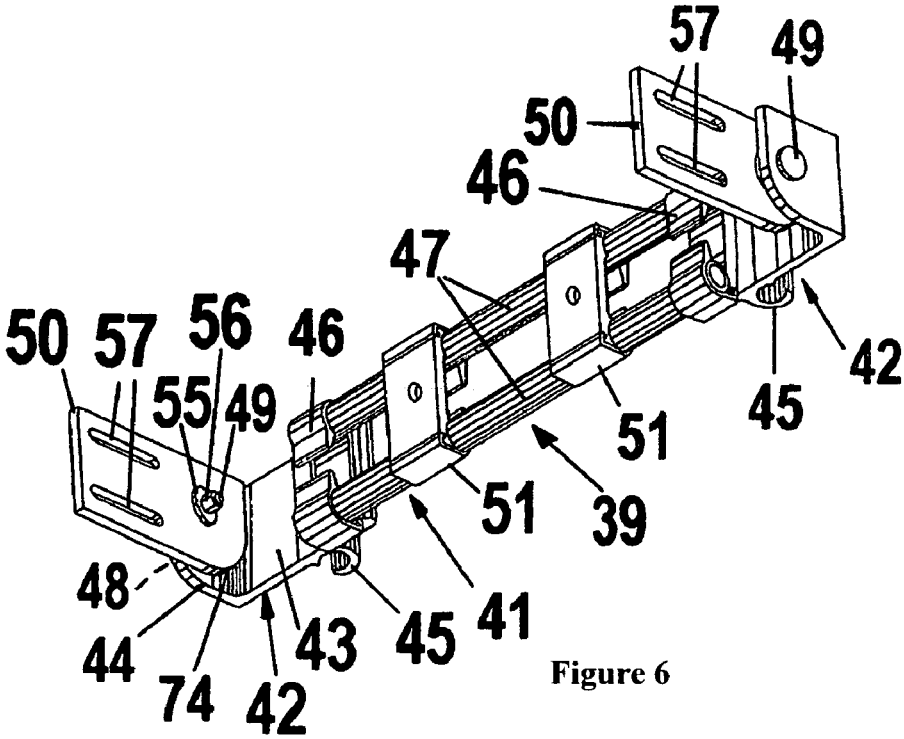
FIG. 6 is an isometric view of the hinge assembly shown in FIG. 3 and FIG. 4 with a double mounting support for a pair of snare drums.

While this connection is shown for a single drum 53 in FIG. 5, it could also be used in assembling two drums 53. In FIG. 6 there are shown details for the connection of two drums 53 to hinge back bar assembly 41.

Figure 4:
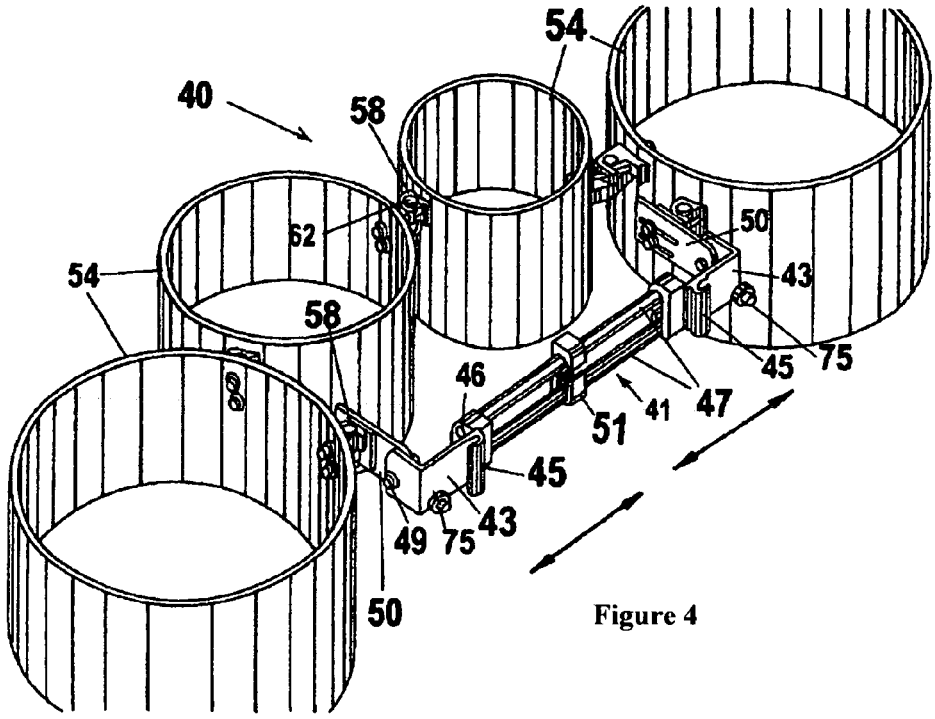
FIG. 4 is an isometric view of the embodiment of supporting illustrating lateral adjustment of the drums.

Each hinge plate 50 has a hole 48, shown in FIGS. 5 and 6, which receives bolt 49 extending through and washer 55 and secured in place by nut 56. Each hinge plate 50 has a pair of slots 57 through which bolts 56 extend to secure a clamping receptacle 58 thereon (FIGS. 3 and 4). The receivers can move on the tenor back member to allow positoning of the drum or drum array relative to the user. The positioning allows the J-rod receivers to be moved on the tenor back member. The receivers can be laterally move together, apart, symetrical or non-symetrically on the tenor back member. This allows the drum array to be moved closer to the user, farther away from the user, justified left or right of the user, or centered in relationship to the user.

A minimum of one receiver is needed to retain the drum postioning system on the carrier, but in the prefered embodiment two receivers are used. In another embodiment three or more receivers are used to allow quick position changing of the drum array by simply lifting the array off one set of receivers, and placing the drum array onto a second set of receivers.

Assembly of Drum Array on Hinge

The assembly of hinge assembly 41 and the array of drums 40 together is best followed and understood by starting with the bare hinge assemblies and placing the components thereon step by step.

FIGS. 7-10 show details of the connection of the individual drums into an array using pairs of receptacles 58. The clamping receptacle 58 is of a type available commercially and is described more completely in FIGS. 39-41, 47-49, and 52-55 of May U.S. Pat. No. 6,028,257. Clamping receptacles 58 are cast or extruded and have a base portion 59 for mounting and an open edge portion 60 which can flex to clamp rods or posts adjustably.

Receptacles 58 may have a cylindrical inner surface 61 or a polygonal inner surface 61 to clamp on a supporting or connecting rod or post 62. Bolts 63 extend through open edge portion 60 and base 59 of receptacles 58 and slots 57 to be held in place by nuts 64. Tightening of nuts 64 secures receptacle 58 tightly on rods or posts 62. Receptacles 58 are arranged on the large drums 54 to each other as an array 40 of drums, with the receptacles on outermost drums 64 supporting the array on hinge plates 50.

Figure 7:
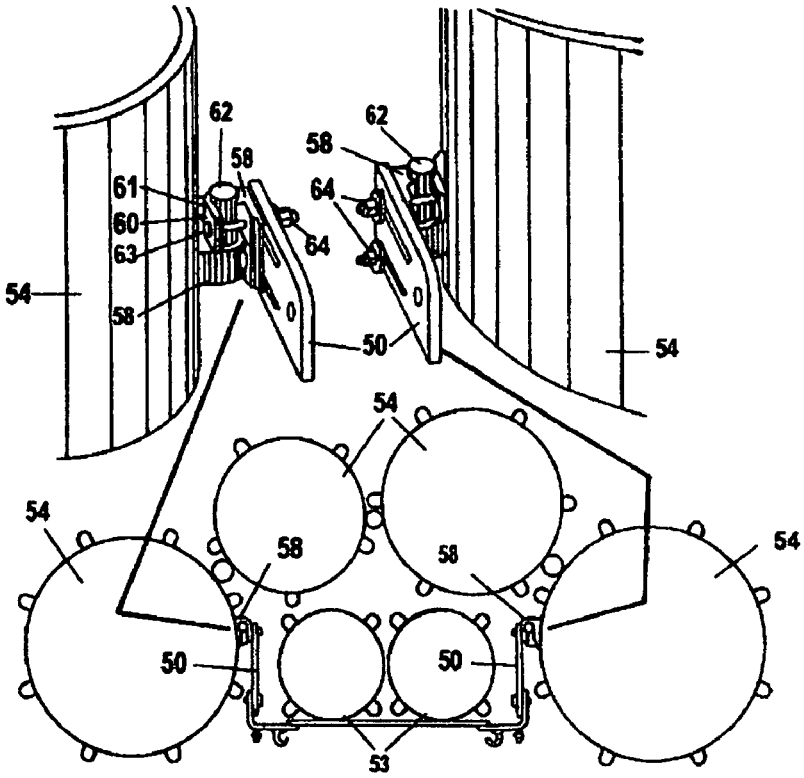
FIG. 7 is a plan view of the hinge assemblies of FIGS. 3-6 with detail isometric views, in exploded relation thereto, showing the hardware supporting the two outer large drums on the hinge.
Figure 8:
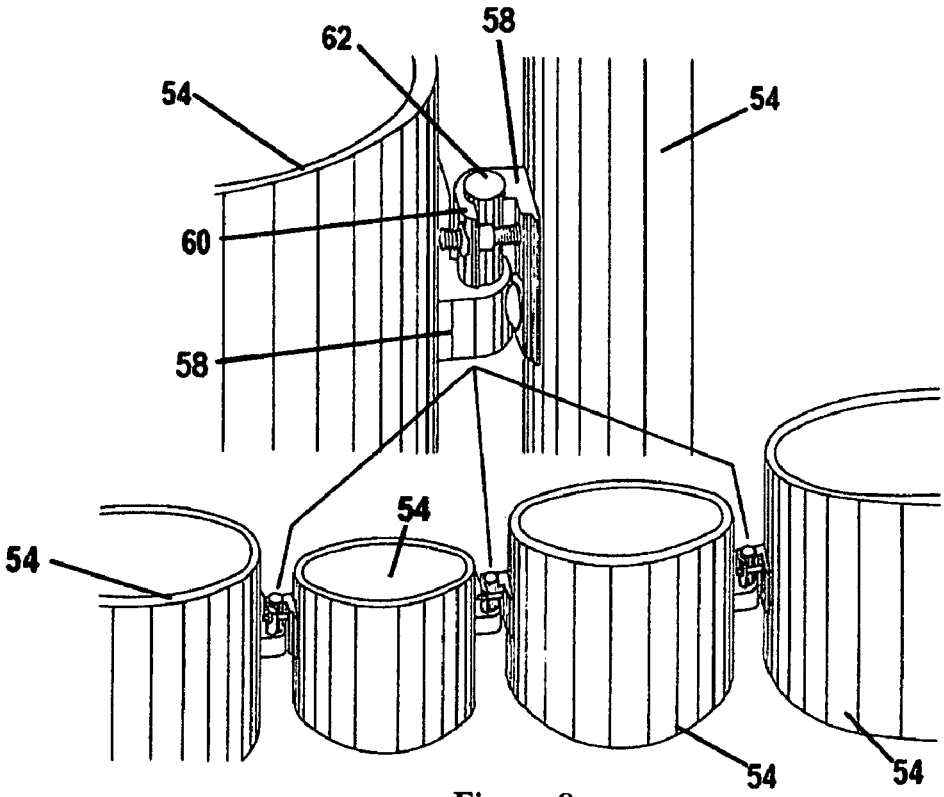
FIG. 8 is a plan view of the hinge assemblies of FIGS. 3-6 with detail isometric views, in exploded relation thereto, showing the hardware supporting the outer large drums to each other.
Figure 9:
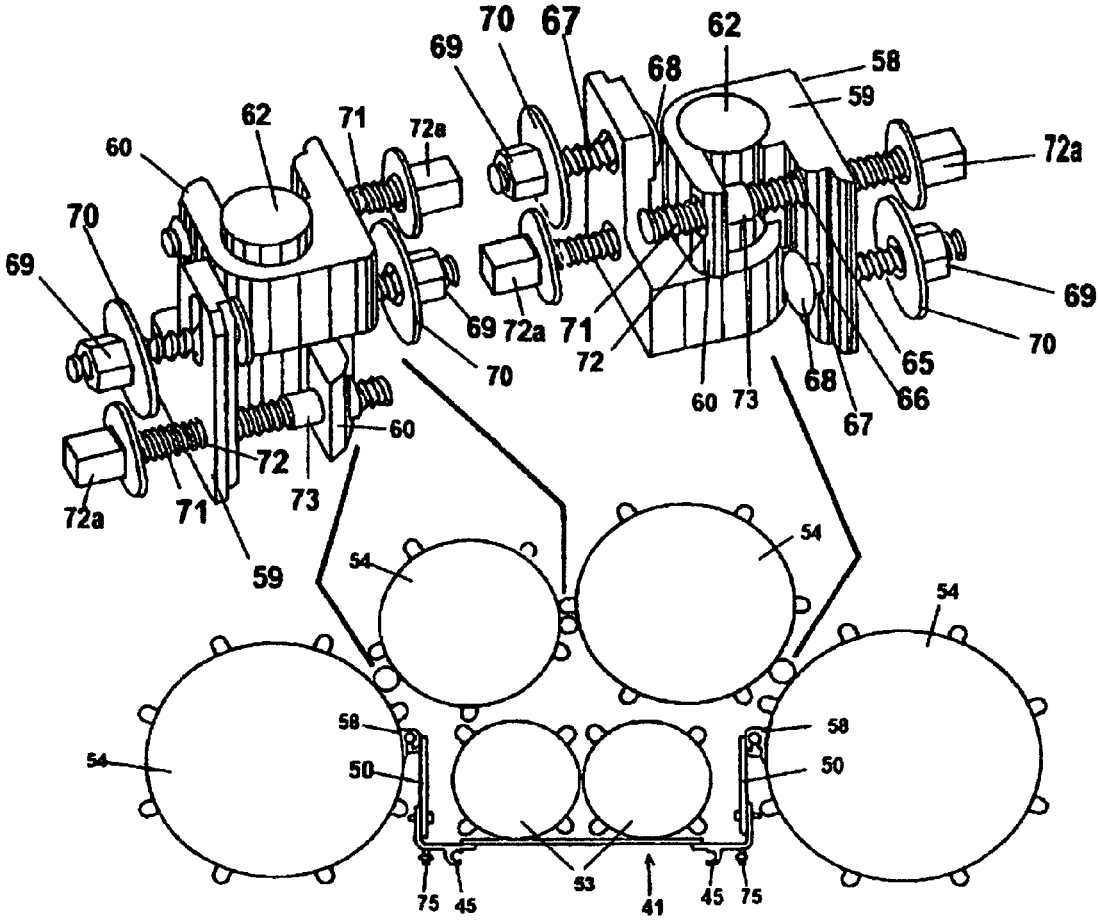
FIG. 9 is a plan view of the hinge assemblies of FIGS. 3-6 with detail isometric views, in exploded relation thereto, showing the hardware supporting the two outer large drums on the hinge.
Figure 10:
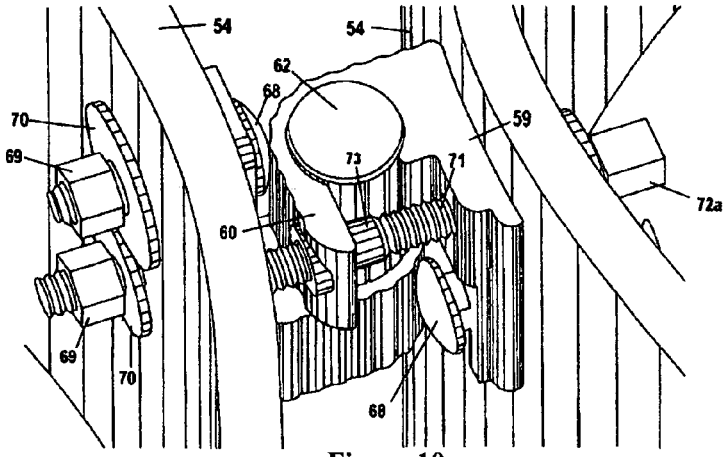
FIG. 10 is a fragmentary isometric view of the hardware supporting the two outer large drums on the hinge.

FIGS. 7-9 show four of the larger drums 54 secured by receptacles 58. On adjacent drums 54, receptacle 58 has a base 59 twice the width of open edge portion 60. Holes 65 and 66 (FIG. 9) in base 59 are aligned with similarly spaced holes in the shell of drum 54. Bolt 67 has a head 68 positioned on the outside of base 58 and extends through the drum shell to be secured in place by nut 69 and washer 70.

Open edge portion 60 has a hole 72 aligned with hole 65 in base 59 and a hole in the drum shell. Bolt 71 has a head 72*a*, shaped for operation by a square drum key, positioned on the inside of the drum shell and extending through the drum shell hole base 58 and extends through hole 66 in base 59 and hole 72 in open edge portion 60. A threaded sleeve 73 fits hole 72 and received the threaded end of bolt 71.

As seen in FIGS. 7-9, receptacles 58 are mounted on adjacent drum shells and aligned to receive connecting rod 62. When bolt 71 is operated to tighten sleeve 73, open edge portions 60 are flexed to clamp connecting rod 62. Prior to clamping, the drums 54 may be adjusted longitudinally and angularly in relation to connecting rod 62.

When four of the drums 54 are connected together as shown in FIGS. 7-9, the array 40, which is produced, is ready for assembly on hinge assembly 41. FIG. 7 shows details of the connection of the drum array 40 to hinge plates 50. FIGS. 5 & 6 show hinge plates 50 supported for pivotal movement on end portions 44 or back bar assembly 41 bolts 49, nuts 56, and washers 55. While four drums are shown in some of the figures, as few as one drum or more than four drums can be located on the back member.

The outermost drums 54 of drum array 40 have receptacles 58 supported thereon (FIGS. 3, 4, 7, 8, 9), as described above for connection of adjacent drums together. Another receptacle 58 is supported on each hinge plate 50 in alignment with the receptacles mounted on the outermost drums 54. The aligned receptacles 58 receive connecting rod 62. When bolt 71 is tightened, open edge portions 60 are flexed to clamp connecting rod 62. The receptacles 58 are mounted on hinge plates 50 in slots 57, which permit the position of the drum array 40 to be adjusted longitudinally of the hinge plates. The drum array can be locked onto the hinge plate, or onto the tenor back member. The drums can be free or locked onto the back member. When two or more drums are connected together with the pivotal linkage, and the connections to the outer drums are moved, the arc formed by the drums changes. FIG. 7 shows the array of four drums as a tighter arc than the array of drums shown in FIG. 8. While FIGS. 7 and 8 show to extreme differences in the arc formed by the array of drums it should be obvious that a large number of variations in the shape of the arc are possible, and that moving the outside drums alters the shape of the arc.

Each hinge plate 50 is pivoted on bolts 49 to a selected position. Each hinge plate 50 has an end portion cut in curvature 74 (FIGS. 5 and 6) shown permitting the edge to clear back bar end portions 42. A set bolt 75 (FIGS. 3, 4 and 9) extends through a threaded hole in back bar end portions 42 to engage the end portion 74 of hinge bar 50 to secure the hinge in a selected position.

Another Embodiment for Supporting Drum Arrays

A hinge assembly 80 (FIGS. 11-16) is provided for supporting a multiple drum assembly or array 81 as used in marching bands. Hinge assembly 80 is similar in function to that shown in FIGS. 11-12 of May U.S. Pat. No. 6,028,257 with additional features permitting adjustability that is not possible in the embodiment of the patent.

Figure 11:
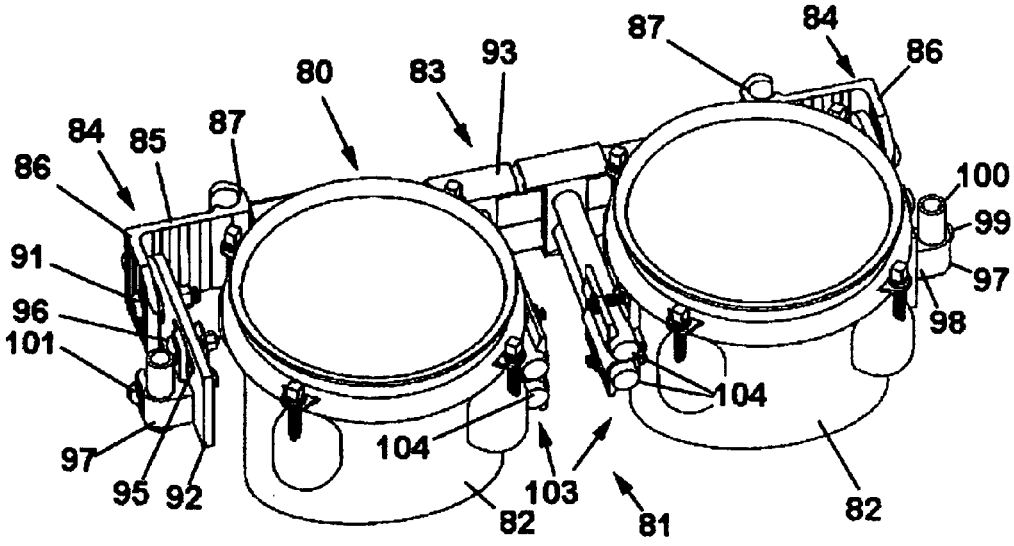
FIG. 11 is an isometric view of another embodiment of supporting hardware supporting an array of drums, as in a marching drum assembly, having a tubular structure supporting a plurality of drums for pivotal and inward and outward adjustment of the drums.
Figure 12:
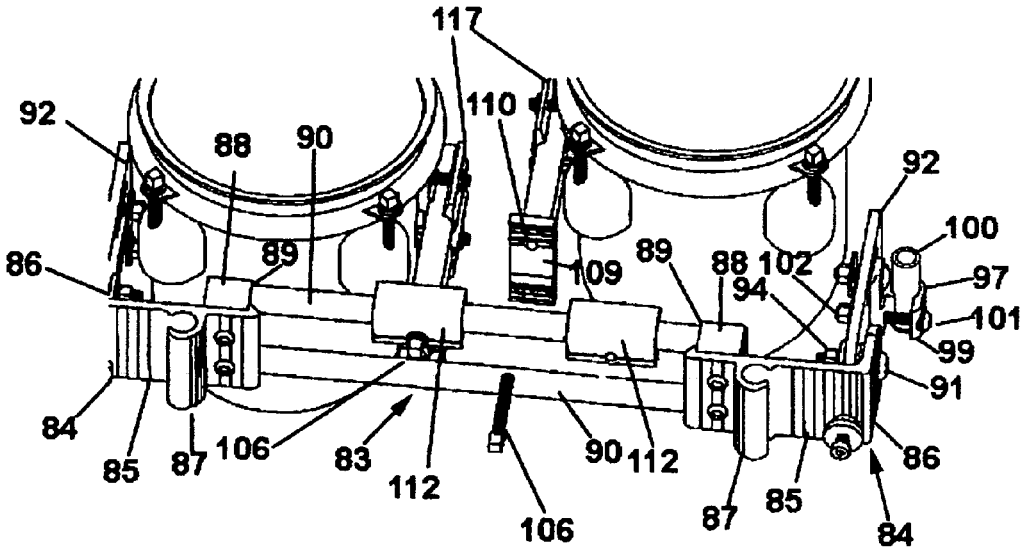
FIG. 12 is isometric view from the rear of the embodiment of supporting hardware shown in FIG. 11 showing details of the pivotal and inward and outward adjustment of the drums.

The drum assembly or array 81 (FIG. 11) comprises at least one drum 82 supported and carried by a drummer as in a marching band. FIGS. 11-12 show the embodiment using two drums, with each drum independently connected to the hinge assembly 80. Drum array 81 includes drums 82 supported on the fixed part of a hinge assembly. It is also contemplated that the drum array 81 can be mounted on the pivotal portion of the hinge assembly. In this embodiment, hinge assembly 80 provides a hinged support between the drum array 81 and a suitable marching carrier 16 or 26 as shown in FIGS. 1 and 2.

Hinge assembly 80 (FIGS. 11 and 12) comprises a back bar assembly 83 that is the fixed member of the hinge. Back bar assembly 83 has two end pieces 84 each of which comprises a one-piece casting having a flat portion 85 with a re-bent portion 86 bent at a right angle thereto.

Flat portion 85 has J-rod receptacles 87 formed integral therewith, in which J-rods are supported and secured in position by compression fit. A socket member 88 with two receptacles 89 is secured on each flat portion 85. Back bar assembly 83 have two cylindrical rods 90 that fit on opposite ends into receptacles 89. The embodiment shown uses two cylindrical rods for the back bar assembly 83, but the rods my be solid and not cylindrical. In another contemplated embodiment the back bar is fabricated from square tubes or rods. In still another contemplated embodiment the back bar assembly can be fabricated from a single rectangular tube or a plate that may also form the end pieces that have been previously shown connected to the cylindrical rods.

Re-bent end portions 86 have holes providing a pivot for the hinge. Holes in each re-bent end portion 86 of back bar flat portion 85 have bolts 91 inserted there through and washer 94 secured by nuts 102 to secure hinge plates 92 which support the drum array 81 for pivotal movement. A supporting member 93 is slidably supported on rods 90 to support the drums 82 (FIGS. 11 and 12). Each hinge plate 92 has a slot 95 through which bolts 96 extend to secure a clamping receptacle 97 thereon.

Receptacles 97 may have a cylindrical inner surface or a polygonal inner surface to clamp on a supporting or connecting rod or post 100. Bolts 101 extend through open edge portion 99 and base 98 of receptacles 97 and slots 95 to be held in place by nuts 102. Tightening of nuts 102 secures receptacle 97 tightly on rods or posts 100.

Drum supports 103 comprise a pair of rods 104 mounted on support plates 109 that are best viewed in FIGS. 13-16. Rods 104 each have one end secured against plate 109 by bolts 106 having square heads for operation by a drumhead key. A shoulder on rod 104 engages on plate 105 to secure rod 104 from rotation.

On the side of plate 109 opposite the rods 104 are roughened curved recesses 110, which fit against rods 90. The upper end of plate 109 has a groove 111, which receives the hooked edge of a spring clip 112. The upper bolt 106 (FIG. 12) passes through the thickened edge portion 114 of spring clip 112 into the end of upper rod 104. When this bolt 106 is tightened, spring clip 112 secures the assembly of rods 104 on the upper rod 90 for rotation thereon, with the lower curved recess 110 resting against the lower rod 90 in the initial position of the assembly at rest.

The rods 104 are cantilevered on rods 90 and support drums 82 at their outer ends. Supporting plate 117 is secured on drum 82 by bolts 106 which extend through supporting plates 117. Bolts 106 and supporting plate 117 on rods 104 can be loosened to allow for sliding movement thereon. FIGS. 13-16 show two tubes connection the drum to the tenor back member, but the connection to the back member can be made from a variety of materials and in a variety of shapes. In any embodiment, at least one member connects to the back member and extends away from the back member. One or more drums connect to the extending member. The attachment of the drum or drums to the extending member allows the drum or drums to be positioned up, down, or angled forward, backward or any combination of orientations. Each drum independently can be oriented to suit the user.

Operation

Hinge assembly 80 is supported by positioning J-rod receptacles 87 over J-rods 135 on a marching vest, and sliding the hinge assembly onto the J-rods. Drums 82 are supported on rods 104 and are movable thereon. Rods 104 are clamped on rods 90 for sidewise adjustment of the spacing of drums 82 and for pivotal adjustment.

Figure 13:
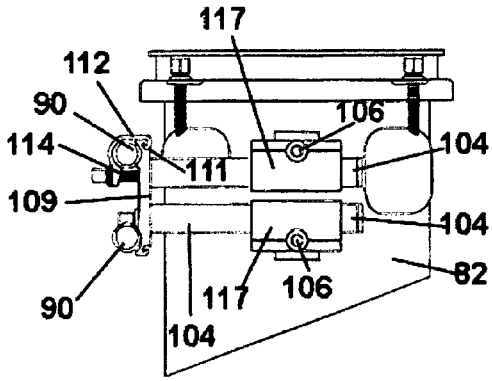
FIG. 13 is a view in side elevation of the embodiment of FIG. 11 with a drum supported in place and illustrating inward and outward adjustment of the drums.
Figure 14:
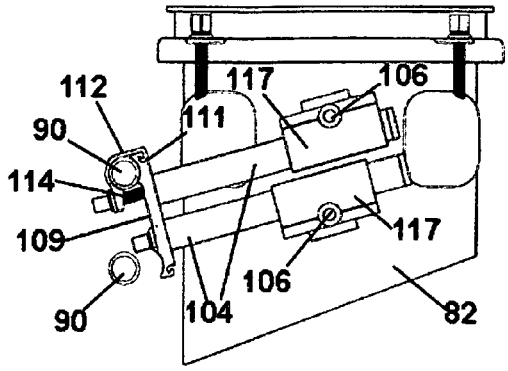
FIG. 14 is a view in side elevation of the embodiment of FIG. 11 with a drum supported in place and illustrating upward and downward adjustment of the drums.

FIGS. 13 and 14 illustrate the operation of this hinge assembly to raise and lower drum 82 while keeping the drumhead level. Supporting plate 109 is pivoted outward to raise drum 82 while clamping plates 117 on the upper and lower rods 104 are adjusted to level the drumhead.

Figure 15:
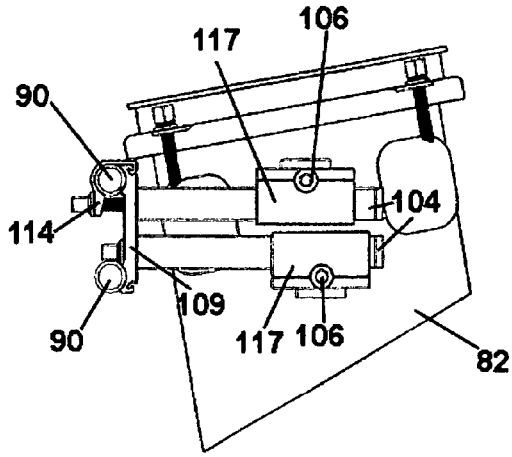
FIG. 15 is a view in side elevation of the embodiment of FIG. 11 with a drum supported in place and illustrating front to back pivotal adjustment of the drums.
Figure 16:
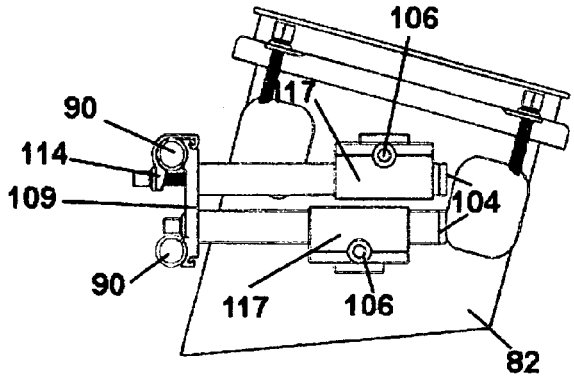
FIG. 16 is a view in side elevation of the embodiment of FIG. 11 with a drum supported in place and illustrating back to front pivotal adjustment of the drums.
Figure 17:
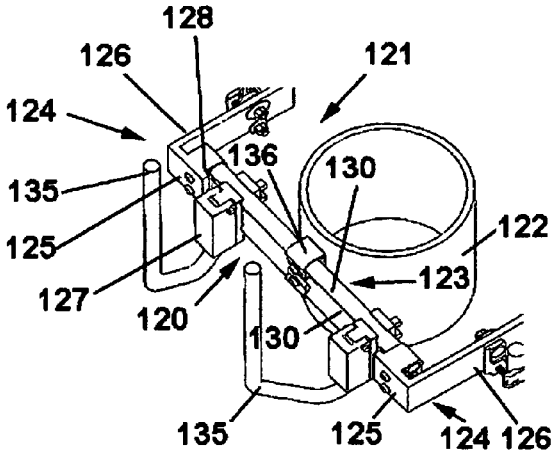
FIG. 17 is an isometric view of an embodiment of supporting hardware supporting an array of drums, as in a marching drum assembly, having hinged sliders for the supporting J-rods of the hardware.
Figure 18:
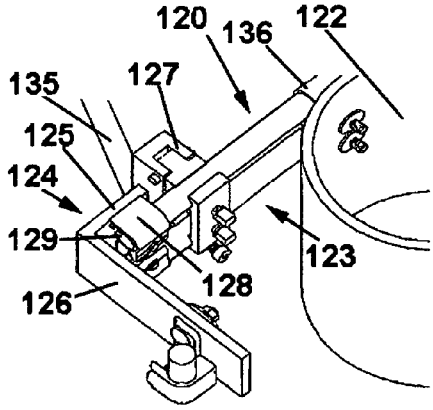
FIG. 18 is a detail isometric view of part of the embodiment shown in FIG. 17.
Figure 19:
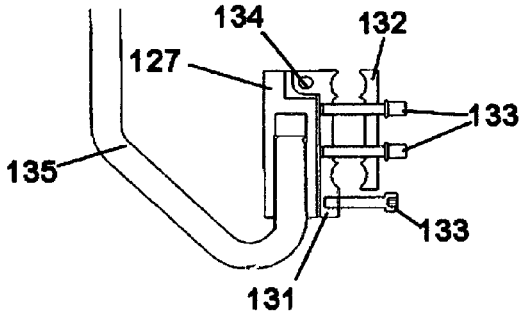
FIG. 19 is a detail view in side elevation of the pivoted hinge in the embodiment shown in FIG. 17.
Figure 20:
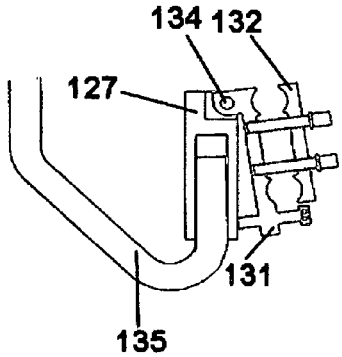
FIG. 20 is a detail view in side elevation of the pivoted hinge in the embodiment shown in FIG. 17 with the hinge in a tilted position.
Figure 21:
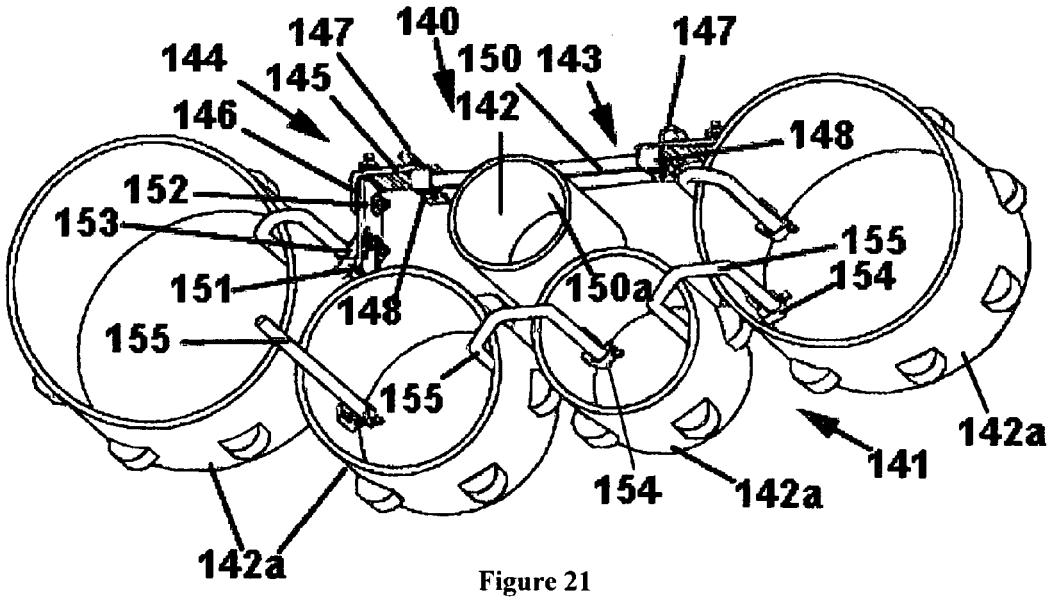
FIG. 21 is an isometric view of another embodiment of supporting hardware supporting an array of drums, as in a marching drum assembly, as in FIG. 3 and FIG. 4, but having a tubular swivel support for the drums fitting existing lugholes in the drums.
Figure 22:
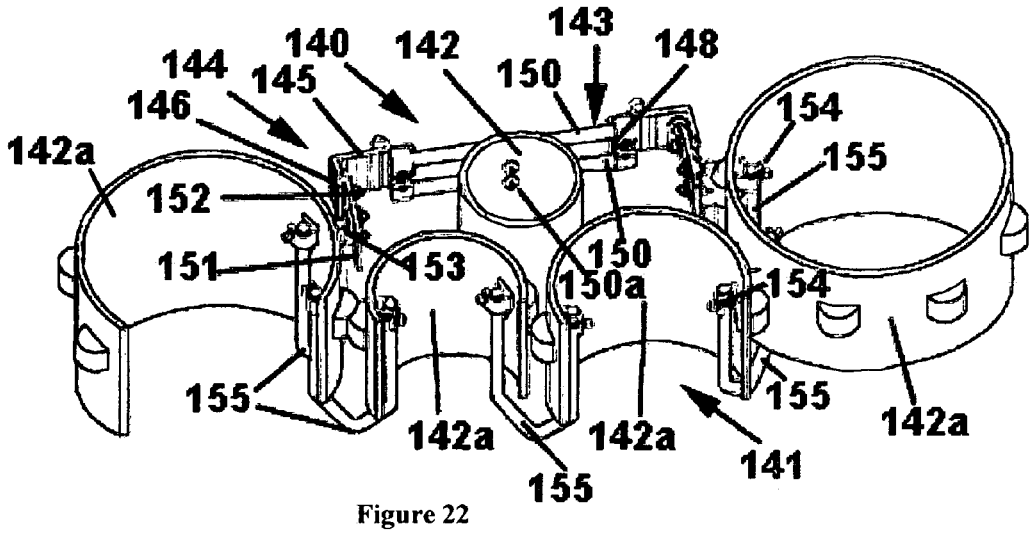
FIG. 22 is a cut away view of the embodiment shown in FIG. 21.

FIGS. 15 and 16 illustrate the operation of this hinge assembly to tilt drum 82 while keeping the drum in a fixed vertical position. Supporting plate 109 is maintained in a vertical position against rods 90 while clamping plates 117 on the upper and lower rods 104 are adjusted to tilt the drum head backward, as in FIG. 15, or to tilt the drum head forward, as in FIG. 16.

A Further Embodiment for Supporting Drum Arrays

Refer now to FIGS. 17-20 that shows a hinge assembly 120 for supporting a multiple drum assembly or array 121 as used in marching bands. Hinge assembly 120 is similar in function to those shown in FIGS. 13-17 of May U.S. Pat. No. 6,028,257 with additional features permitting adjustability that is not possible in the embodiment of the patent.

Multiple drum assembly or array 121 (FIGS. 17, 18) comprises at least one drum 122 secured for support and carrying by a drummer as in a marching band. Drum array 121 includes drum 122 supported on the fixed part of a hinge assembly. In this embodiment, hinge assembly 120 provides a hinged support between the drum array 121 and a suitable marching carrier 16 or 26 as shown in FIGS. 1 and 2.

Hinge assembly 120 (FIGS. 17, 18) comprises a back bar assembly that is the fixed member of the hinge. Back bar assembly 123 has two end pieces 124 each of which comprises a one-piece casting having a flat portion 125 with a bent portion 126 bent at a right angle thereto.

Flat portion 125 has J-rod receptacles 127 formed integral therewith, in which J-rods are supported. A socket member 128 is secured on each flat portion 125. Socket member 128 has two cylindrical rods 130 that fit on opposite ends into receptacles 129. Clamp member 136 supports drum 122 on rods 130. J-rod receptacles 127 are clamped on rods 130 by a split clamp having a base portion 131 (FIGS. 19 and 20) and clamping portion 132 secured thereon by bolts 133. Base portion 131 is hinged to receptacle 127 at 134. The upper two bolts 133 extend through base portion 131 and clamping portion 132 and, when tightened, clamp the receptacle 127 on rods 130. The lowermost bolt 133 extends through base member 131 to engage receptacle member 127 and, when tightened, tilts the clamping members 131, 132 as in FIGS. 19 and 20.

Operation

Hinge assembly 120 is supported by positioning J-rod receptacles 127 over J-rods 135 on a marching vest or on a fixed drum support. Drum 122 is supported on rods 130 and is movable thereon. Drum 122 is supported on rods 90 for sidewise adjustment, and permits adjustment of the spacing if more than one drum 82 is positioned thereon. Rods 130 can be tilted in relation to J-rod receptacles 127 by operation of the lowermost bolt 133 as described above.

A Further Embodiment for Supporting Drum Arrays

A hinge assembly 140 (FIGS. 21 and 22) is provided for supporting a multiple drum assembly or array 141 as used in marching bands. Hinge assembly 140 is similar in function to that shown in FIGS. 13-17 of May U.S. Pat. No. 6,028,257 with additional features permitting adjustability that is not possible in the embodiment of the patent. Multiple drum assembly or array 141 (FIGS. 21 and 22) comprises a plurality of drums 142 and 142*a* s secured for support and carrying by a drummer as in a marching band. Drum array 141 includes drum 142 supported on the fixed part of a hinge assembly and drums 142*a* (shown in broken section) supported on the movable part of the hinge assembly 140. In this embodiment, hinge assembly 140 provides a hinged support between the drum array 141 and a suitable marching carrier 16 or 26 as shown in FIGS. 1 and 2. Hinge assembly 140 (FIGS. 21 and 22) comprises a back bar assembly 143 that is the fixed member of the hinge. Back bar assembly 143 has two end pieces 144 each of which comprises a one-piece casting having a flat portion 145 with a bent portion 146 bent at a right angle thereto. Flat portion 145 has J-rod receptacles 147 formed integral therewith, in which J-rods are supported. A socket member 148 is secured on each flat portion 145. Socket member 148 has two cylindrical rods 150 that fit on opposite ends into receptacles therein. Drum 142 is supported on rods 150 by a clamp member (not shown). Bent portions 146 have plates 151 pivotally supported thereon by hinge bolts 152. J-rod receptors 153 on hinge plates 151 to support drums 142*a*. Each of drums 142*a* has at least two J-rod receptors 154 for supporting and interconnecting the drums by U-shaped rods 155 as seen in the bottom view FIG. 21 and top view FIG. 22. Receptors 154 each have clamping screws or bolts for securing the U-shaped rods 155 therein. Another attribute of the U-shaped rods or tubes 155 is that the rods extend below the bottom surface of the drums. When the drums are removed from the carrier, the drums can be placed onto the U-shaped rods or tubes and suspended from the ground. This allows the drums to be placed on grass or other moist surfaces without moisture making contact with the rim of the drum and possibly causing damage to the drum. The tubes or rods may be coated with a cushion or pad located on the bottom ends of the tubes or rods.

Operation

Hinge assembly 140 is supported by positioning J-rod receptacles 147 over J-rods on a marching vest or on a fixed drum support. Drum 142 is clamped on rods 150, by bolts 150*a*, and is movable thereon for sidewise adjustment, and permits adjustment of the spacing if more than one drum 142 is positioned thereon. Drums 142*a* s are interconnected and supported on hinge plate members 151. This arrangement permits the drums 142*a* to be pivoted relative to the drum carrier and relative to the drum 142 on supporting rods 150.

Thus, specific embodiments and applications for a carrier assembly for percussion instruments have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A drum position adjustment system for an instrument carrier comprising:

at least one receiver on at least one elongated tenor member for attachment to an instrument carrier, wherein the position of the at least one receiver can be laterally adjusted along the at least one elongated tenor member to move the elongated tenor member laterally or in and out relative to the instrument carrier.

2. The drum position adjustment system according to claim 1 further allows at least one drum to tilt or pivot on the at least one elongated tenor rail.

3. The drum positioning system according to claim 1 that includes at least two receivers for attachment to an instrument carrier.

4. The drum positioning adjustment system according to claim 3 that allows lateral adjustment includes positioning the distance between the said receivers on the at least one elongated tenor member.

5. The drum positioning adjustment system according to claim 3 wherein the lateral adjustment includes non-symmetric positioning of the said receivers on the at least one elongated tenor member.

6. The drum position adjustment system according to claim 2 wherein the tilt or pivot can be free, fixed, locked, or infinite increments.

7. The drum position adjustment system according to claim 1 wherein the at least one receiver is configured to accept J-rods.

8. The drum positioning adjustment system according to claim 3 wherein the lateral adjustment consists independent positioning of each receiver.

9. The drum positioning adjustment system according to claim 1 further includes an adjustment that can be locked onto the at least one elongated tenor member.

10. The drum positioning adjustment system according to claim 1 wherein the adjustment can be free to move on the at least one elongated tenor member.

11. The drum position adjustment system according to claim 1 further includes at least one attachment mechanism for at least one drum.

12. The drum position adjustment system according to claim 1 wherein the at least one elongated tenor member is constructed from tubing, rod, plate, or something other than tubing, rod or plate.

13. The drum position adjustment system according to claim 1 wherein the position of the receiver is not adjustable.

14. A drum position adjustment system for an instrument carrier comprising:

at least one receiver for attachment to an instrument carrier, and supporting hardware, for an array of drums serially secured together with a pivotable linkage between at least two adjacent drums, and means for connecting at least one drum to another drum in the array of drums for pivotal movement of one drum relative to another drum.

15. The drum position adjustment system according to claim 14 wherein when the serially secured array of drums is moved the arc formed by the array of drums is altered.

16. The drum position adjustment system according to claim 14 wherein the pivotal movement of the serially secured array of drums allows the array of drums to perform one or more of the following function, narrowed, widened, offset left, offset right, moved closer to the tenor rail, moved farther from the tenor rail.

17. The drum position adjustment system according to claim 14 wherein the serially secured drum array can perform one or more of the following function, offset left, offset right, moved closer to the tenor rail, moved farther from the tenor rail without pivotal movement between the drums.

18. The drum position adjustment system according to claim 14 where at least two drums are different size or tone.

19. The drum position adjustment system according to claim 14 wherein the support hardware uses existing holes in the drum that secures the drum casing on the drum.

20. A drum position adjustment system for an instrument carrier comprising:

at least one receiver for attachment to an instrument carrier connected to at least one elongated tenor rail and at least one elongated drum connector extending perpendicular from the at least one elongated tenor rail for attachment of at least one drum wherein the at least one elongated drum connector has drum securing means that allows the at least one drum to be adjusted of any one or more of the horizontal position, angle, or height of the at least one drum.

21. The drum position adjustment system according to claim 20 wherein the elongated drum connector comprises at least one tube plate or rod.

22. The drum position adjustment system according to claim 20 wherein if more than one drum is attached using an elongated drum connector to the at least one elongated tenor rail, each drum can be independently adjusted.

* * * * *